F6966 XR 4,096,029

United States Patent [19]

Mills

[11] 4,096,029

[45] Jun. 20, 1978

[54] CELLULOSIC PULP DELIGNIFICATION USING AN ACIDIC BROMINE-CHLORINE MIXTURE

[75] Inventor: Jack F. Mills, Midland, Mich.

[73] Assignee: The Dow Chemical Company, Midland, Mich.

[21] Appl. No.: 680,245

[22] Filed: Apr. 26, 1976

[51] Int. Cl.[2] ..... D21C 9/12

[52] U.S. Cl. ..... 162/89; 8/107; 8/108 R; 162/70; 162/72; 162/73; 162/87

[58] Field of Search ..... 162/65, 70, 72, 87, 162/88, 89, 90, 73, 82, 84, 85, 86; 8/107, 108 R, 108 A, 109, 111

[56] References Cited

U.S. PATENT DOCUMENTS

| | | | |
|---|---|---|---|
| 125,658 | 4/1872 | Campbell | 162/87 X |
| 1,942,622 | 1/1934 | Traquair et al. | 162/87 X |
| 2,461,105 | 2/1949 | Bloch et al. | 162/87 X |
| 2,989,519 | 6/1961 | Herbst et al. | 162/87 X |
| 3,150,919 | 9/1964 | Lewin | 8/107 X |
| 3,433,702 | 3/1969 | Jack et al. | 162/87 |

OTHER PUBLICATIONS

Lewin, "Bleaching & Oxidation of Cellulose by Hypobromite & Hypochlorite Bromide Solutions", TAPPI, 6-1965, vol. 48, No. 6, pp. 333-343.

Giertz, "Developments in Bleaching Processes", TAPPI, vol. 34, No. 5, 5-1951, pp. 209-215.

Anders, Zellstoff und Papier, vol. 4, No. 9, 1955, pp. 257-261.

*Primary Examiner*—Arthur L. Corbin

*Attorney, Agent, or Firm*—James B. Guffey; Ralph M. Mellom

[57] ABSTRACT

Efficient lignin removal from cellulosic pulp with decreased cellulose degradation is attained by replacing chlorine with an acidic bromine-chlorine mixture in acidic chlorination of the pulp.

17 Claims, No Drawings

CELLULOSIC PULP DELIGNIFICATION USING AN ACIDIC BROMINE-CHLORINE MIXTURE

This invention relates to processes for delignification and bleaching of cellulosic pulp produced by a chemical pulping process. In another aspect this invention relates to acidic chlorination processes for delignification of cellulosic pulp following a chemical pulping process.

The object of delignification and bleaching of cellulosic pulp is to produce pulp with high brightness, good brightness stability, and maximum pulp strength at minimum cost and with minimum environmental pollution. Unfortunately, however, achievement of or improvement in one of the above factors is often attained only at the expense of another of the important factors.

In an effort to achieve a suitable balance between the competing factors, bleach plants have resorted to multistage processes. A typical bleach plant pulp treatment comprises (a) chlorination (C) of the pulp under acid conditions; (b) alkaline extraction (E) of the chlorinated lignin derivative from the pulp with aqueous sodium hydroxide; (c) oxidation (i.e., bleaching) with sodium hypochlorite (H) under alkaline conditions; (d) a second sodium hydroxide extraction (E); and (e) a final bleach with chlorine dioxide (D).

Such a sequence is labeled CEHED and is commonly used for delignification and bleaching of kraft (i.e., sulfate) pulp. Similar sequences with fewer stages, such as CEH or CED, are commonly used for sulfite pulp which generally contains less lignin and color bodies than does sulfate pulp. Many other such sequences have been proposed and used in the industry's continuing efforts to achieve a suitable balance of the competing factors for the various pulps, pulping processes, and end-use physical property requirements.

Regardless of the sequence used, the bulk of cellulose bleaching still is performed using some combination of chlorination (C), alkaline extraction (E), and oxidation (bleaching) stages. The chlorination stage converts most of the colored lignin which remains after the initial pulping or digestion process to chlorinated lignin derivatives which are partially soluble in acidic chlorine solution and particularly soluble in alkaline extraction liquors. Such stage is also referred to as the delignification stage. Although the net effect of such stage (after alkaline extraction) is generally a darkening of the cellulosic pulp attributable to increased color development in the residual lignin material, a major amount of the lignin is removed in the chlorination-extraction sequence, facilitating efficient bleaching reactions in the later oxidation stages.

An extraction stage generally follows chlorination. Such stage serves to remove the chlorinated lignin derivatives from the cellulose substrate, thus exposing for subsequent treatment the lignin material which was unaffected by the chlorination stage by virtue of the topochemical nature of the reaction. H. W. Giertz "Developments in Bleaching Processes," TAPPI, May, 1951, Vol. 34, No. 5.

Hypochlorite or chlorine dioxide treatment is conducted under alkaline conditions and is primarily characterized by destructive oxidation of residual colored lignin to colorless degradation products. Such stage is, therefore, primarily a bleaching stage, though some minor amount of chlorination followed by extraction by the alkaline bleaching liquors may occur simultaneously.

Of the competition between important factors, the tradeoff between brightness and pulp strength (often measured as pulp viscosity) has been of particular concern to the paper industry and has been primarily responsible for the proliferation of the various bleaching sequences. Such tradeoff apparently results from a non-selective oxidation reaction. By the term non-selective, it is meant that the oxidative action is not limited to lignin oxidation, but instead, also involves destructive oxidation of the cellulosic material, thus reducing the length of the cellulosic molecules and accordingly reducing the strength and viscosity of the pulp. The exact extent of such cellulose oxidation depends uon reaction conditions such as temperature, pH, reaction time, and chlorine concentration, and upon the nature of the pulp being treated. For example, the brightness-strength tradeoff in delignification and bleaching is less pronounced for sulfite pulp than it is for sulfate pulp since less severe treatment is required for sulfite pulp than for sulfate pulp to achieve equivalent brightness characteristics.

The oxidation (i.e., bleaching) aspect of pulp treatment can be performed under acidic conditions by using amounts of the bleaching agent (e.g., chlorine) and treatment times in excess of that required for halogenation of the lignin material. See, for example, U.S. Pat. No. 125,658 wherein the pulp bleaching comprised (a) bleaching the pulp for 10 to 20 minutes with a weak solution of chlorine liquor, (b) bubbling through the pulp-chlorine liquor mixture, via an air blast, a small amount of an aqueous solution containing oxalic acid, alumina, bromine and chlorine, and (c) further bleaching with the chlorine liquor until bleaching was complete. However, under modern pulp treatment sequences, conditions are chosen such that oxidation occurs only as a minor reaction in the acidic chlorination stage and as the major reaction in the alkaline oxidation or bleaching stage. Menachem Lewin, "Bleaching and Oxidation of Cellulose by Hypobromite and Hypochlorite-Bromide Solutions," TAPPI, June, 1965, Vol. 48, No. 6.

Most of the early efforts to obtain the desired brightness characteristics while minimizing the reduction in pulp strength were directed at the alkaline oxidation (i.e., bleaching) stages of bleach plant operation. Some workers reported that carrying out hypochlorite bleaching in the presence of bromine ion improved bleaching efficiency and diminished the danger of affecting the strength of the pulp so treated. U.S. Pat. No. 2,461,105. Other workers reported, at lower bromine ion concentrations, that bromine ion addition had the opposite effect of accelerating the rate of oxidation of cellulose molecules while maintaining the same brightness characteristics. U.S. Pat. No. 2,989,519. Still other work has been performed with sulfite pulp in which the hypochlorite was totally replaced by hypobromite in a single alkaline bleaching step. The goal of such work was to exploit the coexistence of free bromine (for bromination) and hypobromite (for oxidation) under alkaline conditions (for extraction) by accomplishing halogenation, extraction and oxidation in a single stage. While the results indicated that hypobromite bleaching proceeded 5 to 6 times faster than hypochlorite bleaching, both the brightness and strength of single stage hypobromite bleached pulp were inferior to that obtained with a single stage hypochlorite bleach. Anders, Zellstoff und Papier, Vol. 4, No. 9, p. 257–261, (1955).

As progress has been made in reducing the cellulose degradation in the oxidation stages, it has been found that the chlorination stage of pulp treatment contributes substantially to pulp degradation. To reduce the degradation in the chlorination stage, various approaches have been taken. Methods have been sought for reducing the amount of chlorine used and chlorination stage additives, such as chlorine dioxide, sulfamic acid, urea, ammonium hydroxide, and ammonium chloride have been employed. C. W. Heckroth, "Bleaching: A Brighter Future Ahead," Pulp and Paper, pp. 30–40, May 15, 1967. Another approach has been to develop improved chlorination methods such as gas phase chlorination (U.S. Pat. No. 3,579,419). Yet another approach, reported with the aforementioned work by Anders for sulfite pulp, was the replacement of the chlorination stage with an acidic bromination stage for delignification.

While these various approaches have produced some advantages, other problems have been raised.

Thus, for example, the addition of chlorine dioxide to the chlorine in the chlorination stage reduces oxidative cellulose degradation; however, it suffers from disadvantages of cost, poor stability, and high corrosivity. Sulfamic acid is even more costly than chlorine dioxide and, like the other ammonia based degradation inhibitors, can create fish toxicity problems through the formation of chloroamines which are eventually released to the environment. The higher cost of bromine in comparison to chlorine militates against its utilization as a complete replacement for chlorine. Moreover, Anders reports regarding his work with sulfite pulp that, while bromine did not change the cellulosic fiber properties in the acid pH range, a two-stage bromination-hypobromination sequence provided worse pulp whiteness than was obtainable with a single hypochlorite bleach yielding equivalent pulp strength.

I have now discovered that in a liquid phase process for delignification of cellulosic pulp involving halogenation and extraction stages, wherein the halogenation is conducted by contacting such pulp with chlorine under acidic conditions and wherein lignin is extracted from such pulp in one or more alkaline extraction stages; reduction in the amount of oxidative degradation (as indicated by a reduction in the loss in pulp viscosity) of cellulose is obtained without a corresponding reduction in the extent of lignin removal, by the improvement wherein the chlorine is replaced by a bromine-chlorine mixture comprising between about 10 and about 70 weight percent bromine. Moreover, the brominated derivatives are more readily degraded chemically, i.e., in the caustic extraction stage, photochemically and biologically than are their chlorinated analogs. Also, there is potentially the opportunity to improve pulp yields and to reduce water, heat, and caustic requirements and thus pollution problems by using bromine-chlorine mixtures in new bleaching sequences. Fish toxicity problems may also be reduced near paper mills where degradation inhibitors such as ammonia are used as the use of bromine-chlorine mixtures eliminate the need for ammonia to prevent cellulose degradation and low pulp viscosities. Further, the use of bromine-chlorine mixtures eliminate the need for special corrosion resistant processing equipment in paper mills using chlorine dioxide as an acidic delignification degradation inhibitor as the use of bromine-chlorine mixtures eliminate the need for chlorine dioxide to prevent cellulose degradation and low pulp viscosities.

The present ivention is applicable to all liquid phase acidic chlorination processes for the delignification of wood pulp produced by chemical pulping processes. Thus, bromine-chlorine mixtures are advantageous at pulp consistencies used in the industry for liquid phase acidic chlorination. As a general rule the pulp consistency (i.e., cellulose content) employed in such liquid phase processes is between about 1 percent and about 12 percent, more commonly between about 3 percent and about 8 percent, by weight, based upon the total weight of the liquid-pulp mixture. In such liquid phase acidic chlorination processes, the liquid in which the pulp is dispersed is preferably water.

The present invention is adaptable to most of the many multi-stage bleaching sequences presently in use which, in addition to halogenation and alkaline extraction stages, further involve one or more oxidation stages (e.g., a halogenation, extraction and oxidation sequence or a halogenation, extraction, oxidation, extraction and oxidation sequence). Bromine-chlorine mixtures are particularly advantageous in processes employing higher temperatures because of the greater bromine-chlorine solubility compared to that of chlorine alone.

While the present invention is applicable to acidic halogenation (i.e. delignification) stage treatment of chemical pulps prepared by either the kraft (i.e., sulfate) process or the sulfite process, it is particularly advantageous when employed in pulp treatment sequences for sulfate pulps since such pulps require more severe delignification stage conditions than sulfite pulp to achieve suitable brightness characteristics and thereby suffer proportionately greater oxidative cellulose degradation.

The ratio of bromine to chlorine in the bromine-chlorine mixture used in a given embodiment of the invention will vary as required to achieve, for the particular pulp being treated, the desired pulp properties, such as pulp viscosity and lignin content, at acceptable levels of cost and environmental impact. However, as a general rule, the invention employs bromine-chlorine mixtures comprising a minimum bromine content of about 10 percent, preferably about 20 percent, most preferably about 25 percent, and a maximum bromine content of about 70 percent, preferably about 60 percent, most preferably about 45 percent by weight based upon the total weight of such mixture.

The bromine moiety of the bromine-chlorine mixture can be in the form of elemental bromine; bromine-chloride (i.e., BrCl); alkali metal, or alkaline earth metal, bromide salts in the presence of an appropriate oxidizing agent, such as chlorine; alkali metal, or alkaline earth metal, hypobromite salts; bromine-releasing organic compounds, such as dibromodimethyl hydantoin; or mixtures thereof. It is thus apparent that the bromine moiety can be provided from a variety of sources without departing from the spirit and scope of the invention.

While the present invention is generally practiced by simultaneous addition of the appropriate amounts of bromine and chlorine to the pulp either as a mixture or as separate and distinct halogenating components, sequential addition of such amounts of bromine and chlorine can also be advantageously employed. When the bromine and chlorine are added sequentially as distinct components, either bromine or chlorine can constitute the first halogenating component added. When sequential addition of bromine and chlorine is employed, the acidic halogenation stage can be viewed as a single stage or as a multiple mini-stage acidic halogenation within an overall acidic halogenation process comprising a combination of one or more acidic brominations and one or more acidic chlorinations. Alkaline extraction stages can be interposed between some or all of the sequential chlorine or bromine additions. However, such intermediate alkaline extractions within the overall acidic halogenation process are not preferred as they require additional processing steps, additional equipment and additional extraction liquor.

The amount of halogen (i.e., bromine-chlorine mixtures) required in the practice of this invention depends primarily upon the lignin content of the pulp immediately prior to the acidic halogenation stage and upon the degree of lignin removal desired to be achieved via the halogenation stage-extraction stage sequence. As a general rule, however, the bromine-chlorine mixtures are employed at minimum concentrations of about 4 percent, preferably about 5 percent, most preferably about 6 percent, and at maximum concentrations of about 14 percent, preferably about 10 percent and most preferably about 8 percent, by weight based upon the dry weight of the cellulosic pulp.

The lignin content of the cellulosic pulp, both before the acidic halogenation stage and after the acid halogenation-alkaline extraction stage sequence, can be conveniently determined by obtaining the permanganate number (K). This is the number of milliliters of 0.1 N $KMnO_4$ required to oxidize the lignin in one gram of dry pulp. The difference between the permanganate number before the acidic halogenation stage and the permanganate number after the acidic halogenation-alkaline extraction stage sequence provides a measure of the amount of lignin removed by such sequence.

The lignin content of pulp entering the acidic halogenation is dependent upon a variety of factors, such as the natural (i.e., original) source of the cellulosic material, the pulping process employed in the pulp preparation and the conditions under which such pulping process was conducted. Generally, however, pulp treated pursuant to the present invention will exhibit a pre-delignification permanganate number between about 15 and about 35, more commonly between about 15 and about 25.

The lignin content of the pulp following acidic halogenation and subsequent alkaline extraction is also dependent upon a variety of factors such as the nature of the cellulosic pulp, including its natural source, pulping treatment and pre-delignification lignin content; the amount and bromine content of the bromine-chlorine mixture employed; and the conditions, such as time, temperature, pressure and pH under which the acidic halogenation is performed. However, as a general rule, pulp delignified pursuant to this invention will exhibit, a post-delignification permanganate number between about 3 and about 10, preferably between about 3 and about 6 and most preferably between about 3.5 and about 5.

The extent of cellulose degradation, and accordingly the loss in pulp strength, can be determined by measuring the pulp viscosity. After the acidic halogenation-alkaline extraction sequence, pulp samples can be dissolved in cupriethylene diamine solutions and the solution viscosities can be measured using an Ostwald viscosimeter.

To avoid cellulose attack lignin removal should be accomplished as fast as possible, at the lowest practicable temperatures at which acid halogenation of the lignin occurs at an acceptable rate, and at low pH values. As a general rule, the acidic halogenation pursuant to this invention will be performed within a period of between about 10 and about 90 minutes, preferably between about 30 and about 60 minutes and at a temperature between about 10° and about 80° C, preferably between about 20° and about 50° C. The cellulosic pulp will generally be neutral (i.e., pH = 7) or slightly alkaline prior to the addition of the bromine-chlorine mixtures in the acidic halogenation stage. However, the pulp will rapidly become acidic upon halogen addition. While it is possible to maintain the pulp at a weakly acidic value (i.e., pH values only slightly less than 7) by the addition of a base such as sodium hydroxide, as a general rule it is preferably that the pH be between about 1 and about 3.5, most preferably between about 1 and about 2.5, upon complete addition of the bromine-chlorine mixture to the pulp.

SPECIFIC EMBODIMENTS

In each of the examples below, a 300 gram sample of unbalanched kraft pulp was dispersed in eight liters of tap water. The pulp was halogenated to about 3 percent consistency (i.e., about 3 grams of pulp per 100 grams of water-pulp mixture) by adding the required amount of halogen dissolved in two liters of tap water. After halogenation, the pulp was washed several times to remove residual halogen and lignin products. After squeezing the washed, halogenated pulp, its consistency (about 25 percent) was determined by making a mat and then drying and weighing the paper sheet. The amount of 1 N NaOH required to give 3 percent caustic on a dry pulp basis was calculated and added along with tap water to give 12 percent consistency. The caustic-pulp mixture was kneaded in polyethylene bags and the bags were then placed in a hot water bath at 160° F. After two hours extraction, the pulp was removed from the bags and washed thoroughly to remove residual caustic and soluble lignous products. A paper mat was made and used to determine viscosities and permanganate numbers.

Pulp viscosities, using TAPPI method T230 sm-50, were determined as follows: A 0.250 gram portion of oven-dried pulp, which was pre-fluff dried using an acetone wash, was dissolved in a solution containing 25 ml 0.1 N cupriethylene-diamine and 25 ml of D.I. water. The mixture was stirred 15 minutes and 10 ml was pipetted into an Ostwald viscosimeter tube and measured at 25° C. The viscosity was calculated in centipoise (cp) from the equation:

$$\text{Viscosity (cp)} = CTd$$

where T is time in seconds, d is the density of the solution (1.052), and C is the Ostwald tube constant (0.10895 determined).

The permanganate number (K) was determined using the TAPPI T214 m-50 method. One gram of a representative oven-dried sample of pulp was disintegrated in 700 ml of distilled water containing 25 ml 4 N $H_2SO_4$. A 25 ml portion of 0.1 $KMnO_4$ was added and stirred for 5 minutes ±10 seconds. The oxidation reaction was then stopped by adding 5 ml of saturated KI solution. The liberated iodine was titrated with 0.1 N sodium thiosulfate and the permanganate number calculated $$K = \frac{\text{ml } KMnO_4 - \text{ml } Na_2S_2O_3}{\text{o. d. wt. of pulp}}$$

EXAMPLES 1-13 AND COMPARATIVE EXAMPLES A-D

Table I gives the effect of bromine on permanganate numbers wherein various amounts of chlorine are compared with bromine-chlorine mixtures.

TABLE I

EFFECT OF BROMINE ON PERMANGANATE NUMBERS (Measure of Lignin Content of Wood Pulp)

| Ex. | Halogen | Bromine Content (wt %) | Halogen[1] Content (wt %) | Equivalent[2] Chlorine (wt %) | Average $KMnO_4$ No. |
|---|---|---|---|---|---|
| A | none | — | — | — | 19.4 |
| B | $Cl_2$ | — | 4.0 | 4.0 | 7.0 |
| C | " | — | 6.0 | 6.0 | 6.7 |
| D | " | — | 8.0 | 8.0 | 4.9 |
| 1 | BrCl | 69.3 | 4.0 | 2.5 | 9.3 |
| 2 | " | " | 8.0 | 5.0 | 6.4 |
| 3 | " | " | 13.0 | 8.0 | 4.8 |
| 4 | $BrCl_3$ | 42.9 | 8.0 | 6.1 | 4.4 |
| 5 | $BrCl_5$ | 31.1 | 8.0 | 6.6 | 4.1 |
| 6 | " | " | 11.0 | 9.1 | 3.8 |
| 7 | $BrCl_6$ | 27.3 | 4.0 | 3.4 | 7.9 |
| 8 | " | " | 6.0 | 5.1 | 6.3 |
| 9 | " | " | 8.0 | 6.8 | 4.2 |
| 10 | $BrCl_7$ | 24.4 | 8.0 | 6.9 | 4.5 |
| 11 | $BrCl_9$ | 20.0 | 8.0 | 7.1 | 4.4 |
| 12 | $BrCl_{13}$ | 14.8 | 8.0 | 7.3 | 4.2 |
| 13 | $BrCl_{20}$ | 10.1 | 8.0 | 7.5 | 4.2 |

[1]Percent by weight based on dried kraft wood pulp. The pulp samples were prepared by halogenating at ambient temperature at 3 percent consistency for 60 minutes; caustic extraction was done at 3 percent NaOH at 12 percent consistency for 120 minutes at 160° F.

[2]Equivalent Chlorine represents the weight percent of chlorine that would be required to provide the same number of halogen atoms as is provided by the stated weight percent of bromine-chlorine mixture. This column permits comparison of lignin removal effectiveness on the basis of equal halogen atom concentration.

As is apparent from analysis of Table I, the bromine-chlorine mixtures (with the exception of Examples 1 and 7) provided better lignin removal than chlorine alone at equal or lower halogen atom (i.e., equivalent $Cl_2$) concentrations. With the exception of Example 2, bromine-chlorine mixtures provided better lignin removal than chlorine alone at 8 weight percent halogen loadings.

EXAMPLES 14-26 AND COMPARATIVE EXAMPLES E-G

Examples 14 through 26 denoting pulp samples which had been delignified by using various bromine-chlorine mixtures, were compared as to viscosity with samples delignified with chlorine alone. The samples were prepared in the same manner as Examples 1-13 and comparative Examples B-D. The results are summarized in Table II.

TABLE II

EFFECT OF BROMINE ON VISCOSITY OF KRAFT WOOD PULP AFTER HALOGENATION AND CAUSTIC EXTRACTION

| Example | Halogen | Halogen[1] Content (wt %) | Average $KMnO_4$ No. | Viscosity[2] (cp) |
|---|---|---|---|---|
| E | $Cl_2$ | 4 | 7.0 | 24.1 |
| F | " | 6 | 6.7 | 21.8 |
| G | " | 8 | 4.9 | 12.5 |
| 14 | $BrCl_{20}$ | 8 | 4.2 | 13.2 |
| 15 | $BrCl_{13}$ | 8 | 4.2 | 14.0 |
| 16 | $BrCl_9$ | 8 | 4.4 | 16.0 |
| 17 | $BrCl_7$ | 8 | 4.5 | 19.7 |
| 18 | $BrCl_6$ | 4 | 7.9 | 25.5 |
| 19 | " | 6 | 6.3 | 24.5 |
| 20 | " | 8 | 4.2 | 21.2 |
| 21 | $BrCl_5$ | 8 | 4.1 | 20.0 |
| 22 | " | 11 | 3.8 | 16.7 |
| 23 | $BrCl_3$ | 8 | 4.4 | 20.6 |
| 24 | BrCl | 4 | 9.3 | 21.2 |
| 25 | " | 8 | 6.4 | 22.2 |

TABLE II-continued

EFFECT OF BROMINE ON VISCOSITY OF KRAFT WOOD PULP AFTER HALOGENATION AND CAUSTIC EXTRACTION

| Example | Halogen | Halogen[1] Content (wt %) | Average $KMnO_4$ No. | Viscosity[2] (cp) |
|---|---|---|---|---|
| 26 | " | 13 | 4.8 | 21.9 |

[1]Percent by weight based upon dried kraft wood pulp. The pulp samples were prepared by halogenating at ambient temperature at 3 percent consistency for 60 minutes; caustic extraction was done at 3 percent NaOH at 12 percent consistency for 120 minutes at 160° F.

[2]The pulp viscosity before halogenation was 22 cp.

As is apparent from analysis of Table II, bromine-chlorine mixtures provided higher pulp viscosity than did chlorine alone at halogen concentrations of 8 weight percent based upon the weight of dry pulp. Further, the data shows that, at halogen concentration sufficient to attain permanganate numbers less than that obtained with pure chlorine at an 8 weight percent concentration, the bromine-chlorine mixtures produce higher pulp viscosity than does chlorine alone at such 8 weight percent concentration.

As can be seen, the partial replacement of chlorine with bromine in the chlorination stage of a cellulosic pulp processing sequence enables one to remove lignin from kraft wood pulp without undue cellulosic attack. Similarly, other cellulosic pulps may be delignified with the use of bromine-chlorine mixtures with comparable good results.

While the present invention has been described with reference to particular embodiments, it should be understood that such embodiments are not intended to limit the scope of the instantly claimed invention.

What is claimed is:

1. In a liquid phase process for delignification of cellulosic pulp involving halogenation and extraction stages wherein the halogenation is conducted by contacting such pulp with chlorine under acidic conditions and wherein lignin is extracted from such pulp in one or more alkaline extraction stages; the improvement comprising replacing the chlorine with an acidic bromine-chlorine mixture comprising between about 10 and about 70 weight percent bromine.

2. A process of claim 1 wherein the bromine-chlorine mixture comprises between about 20 and about 60 weight percent bromine.

3. A process of claim 1 wherein the bromine-chlorine mixture comprises between about 25 and about 45 weight percent bromine.

4. A process of claim 1 wherein the process further involves one or more oxidation stages.

5. A process of claim 4 wherein the process comprises sequentially halogenation, extraction, and oxidation.

6. A process of claim 4 wherein the process comprises sequentially halogenation, extraction, oxidation, extraction and oxidation.

7. A process of claim 1 wherein the concentration of the bromine-chlorine mixture is between about 4 and about 14 weight percent based on the dry weight of the cellulosic pulp.

8. A process of claim 1 wherein the concentration of the bromine-chlorine mixture is between about 6 and about 14 weight percent based on the dry weight of the cellulosic pulp.

9. A process of claim 1 wherein the concentration of the bromine-chlorine mixture is between about 6 and about 10 weight percent based on the dry weight of the cellulosic pulp.

10. A process of claim 1 wherein the concentration of the bromine-chlorine mixture is between about 6 and about 8 weight percent based on the dry weight of the cellulosic pulp.

11. A process of claim 1 wherein the halogenation is conducted in the liquid phase at a pH of between about 1 and about 3.5.

12. A process of claim 1 wherein the cellulosic pulp is pulp prepared by the sulfate process.

13. A process of claim 1 wherein the cellulosic pulp exhibits a pre-delignification permanganate number between about 15 and about 35.

14. A process of claim 13 wherein the cellulosic pulp exhibits a post-delignification permanganate number between about 3 and about 10.

15. A process of claim 1 wherein the cellulosic pulp exhibits a post-delignification permanganate number between about 3 and about 10.

16. The process of claim 1 wherein the cellulosic pulp exhibits a post-delignification permanganate number between about 3 and about 6.

17. The process of claim 1 wherein the bromine-chlorine mixture comprises between about 10 and about 45 weight percent bromine and wherein the concentration of the bromine-chlorine mixture is between about 6 and about 8 weight percent based upon the dry weight of the cellulosic pulp.

* * * * *

UNITED STATES PATENT AND TRADEMARK OFFICE

CERTIFICATE OF CORRECTION

PATENT NO. : 4,096,029

DATED : June 20, 1978

INVENTOR(S) : Jack F. Mills

It is certified that error appears in the above-identified patent and that said Letters Patent are hereby corrected as shown below:

Column 4, line 1, delete "ivention" and insert --invention--.

Column 6, line 13, delete "preferably" and insert --preferable--.

Column 6, line 20, delete "unbalanched" and insert --unbleached--.

Column 6, line 21, delete "to" and insert --at--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*